United States Patent [19]

Oeschsle et al.

[11] Patent Number: 4,711,627

[45] Date of Patent: Dec. 8, 1987

[54] DEVICE FOR THE THERMAL SPRAY APPLICATION OF FUSIBLE MATERIALS

[75] Inventors: Manfred Oeschsle, Bad Homburg; Uwe Szieslo, Waldems; Karl-Peter Streb, Markt Mombria, all of Fed. Rep. of Germany; Wolfgang Simm, Ecublens, Switzerland

[73] Assignee: Castolin S.A., Lausanne, Switzerland

[21] Appl. No.: 731,999

[22] PCT Filed: Aug. 27, 1984

[86] PCT No.: PCT/DE84/00173

§ 371 Date: Apr. 24, 1985

§ 102(e) Date: Apr. 24, 1985

[87] PCT Pub. No.: WO85/00991

PCT Pub. Date: Mar. 14, 1985

[51] Int. Cl.[4] ..... F23N 5/00; F23C 5/06

[52] U.S. Cl. ..... 431/30; 431/160; 431/126; 431/256

[58] Field of Search ..... 431/157, 158, 160, 186, 431/256, 266, 30, 257; 432/174; 60/730, 39.827; 122/6 A, 6.5

[56] References Cited

U.S. PATENT DOCUMENTS

| | | | |
|---|---|---|---|
| 2,950,867 | 8/1960 | Hawley et al. . | |
| 3,109,481 | 11/1963 | Yahnke | 431/256 |
| 3,112,072 | 11/1963 | Malone . | |
| 3,209,810 | 10/1965 | Schuvart | 431/186 X |
| 3,311,789 | 3/1967 | Remy | 431/257 X |
| 3,563,683 | 2/1971 | Hess | 431/160 |
| 4,437,415 | 3/1984 | Spielman | 431/160 X |

FOREIGN PATENT DOCUMENTS

| | | |
|---|---|---|
| 81201061 | 4/1982 | European Pat. Off. . |
| 1089614 | 9/1960 | Fed. Rep. of Germany . |

OTHER PUBLICATIONS

Metall, No. 3/83, Mar. 1983, pp. 237–239.

*Primary Examiner*—Randall L. Green
*Attorney, Agent, or Firm*—Kurt Kelman

[57] ABSTRACT

A spray gun comprises a nozzle defining an elongated, axially extending spray channel, a coaxial inlet leading thereto and having a flow-accelerating contour, and a coaxial combustion chamber leading to the inlet, the combustion chamber having a diameter larger than that of the spray channel. A nozzle head is displaceably mounted in the combustion chamber and is axially adjustable with respect to the inlet, the nozzle head feeding the fusible material into the combustion chamber and carrying a burner nozzle and respective conduits feeding a combustion gas and a spray channel flushing gas into the combustion chamber. An ignition electrode projects into the combustion chamber and is arranged for adjustment with respect to the burner nozzle in a direction transverse to the axis, and a control circuit comprises a switching element for supplying electric current to the ignition electrode whereby a spark is formed between the ignition electrode and the burner nozzle for igniting the combustion gas in the combustion chamber, and respective controllers for feeding the combustion gas and the flushing gas through the respective conduits, the control circuit sequentially operating the controller for feeding the flushing gas, the switching element for supplying electric current to the ignition electrode and the controller for feeding the combustion gas.

14 Claims, 8 Drawing Figures

DEVICE FOR THE THERMAL SPRAY APPLICATION OF FUSIBLE MATERIALS

The invention relates to a device for the thermal spray application of fusible materials, consisting of a cooled pinch nozzle having a space expanded on the feeding side for receiving therein devices for the controlled feeding of operating components such as operating gases and fusible material.

Devices of the above type for the thermal spray application of powders are known from German Pat. DAS No. 1 089 614. The additional state of the art is represented by the European patent application No. 812 01061.9 and trade publication "Metall", No. 3/83, page 238, FIG. 1*b*. With the last-mentioned device, nitrogen is used as the conveying gas, whereby the flame (the fuel gas is a mixture of methylacetylene propadiene and oxygen) is formed in the water-cooled pinch nozzle. The process according to European application No. 812 01061.9 requires a costly dosing system with electronic control and timing devices, i.e., said associated equipment is very expensive and its purchase and use is worth the expenditure only in certain cases of application, although with such a system (the operating materials or components are combined with each other according to the equal-pressure principle), it is possible to achieve spraying qualities that can readily bear comparison with those obtained in plasma and flame shock spraying operations, i.e., the quality is very high. However, since said systems cannot be operated with the use of pure acetylene and in view of their high cost, their application is obviously not justifiable for, in a manner of speaking, normal cases of spray application, i.e., in such normal cases, it was not possible until now to exploit with the simpler means the advantages offered by such a process and such a pinch nozzle, namely the prevention or reduction of spraying losses, superior fusion of the particles and higher particle acceleration.

The device according to the afore-mentioned German Pat. DAS No. 1 089 614 is not equipped with a combustion chamber, but designed in a way such that the orifice of the carrier gas/powder outlet duct is arranged directly within the zone feeding into the pinch duct of the pinch nozzle, whereby the expanded space around the nozzle serves only for feeding the oxygen, the latter being admixed with the stream of carrier gas and powder by way of an annular clearance. Aside from the hazard of backfire in the duct feeding the carrier gas and powder, the nozzle is not designed for adjustment, which means no adaption to different types of powder is possible. Furthermore, the entire device has to be ignited from the front, which poses some hazard also.

Therefore, the present invention is based on the problem of providing a device operating with comparably low spraying losses. Said device, which operates based on the so-called differential pressure principle, does not require more or only insignificantly more with respect to equipment expenditure than what was needed until now for flame spraying, on the one hand. On the other hand, by virtue of the adaptability of its combustion chamber, it permits the use of all combustible gases, in particular also the use of acetylene and different types of spray powders. Furthermore, also the ignition or start-up operations can be safely controlled.

Accordingly to the invention, said problem is solved with a device of the type specified above by the following features: The expanded space is designed as the combustion chamber with a flow-accelerating contour of transition into which the pinch nozzle is discharging, and a burner nozzle or a nozzle holder with a nozzle is arranged in said combustion chamber, said nozzle being axially adjustable with respect to the orifice of the pinch nozzle and charged with differential pressure. Furthermore, an ignition electrode is arranged in the wall of the combustion chamber, said electrode being adjustable with respect to the nozzle and provided with a switching element for switching on the electrode after the flushing of the pinch nozzle and before the combustion gas is fed. Advantageous additional features of said solution are disclosed in the subclaims 2 to 14.

Said solution can be realized in the simplest way by combining the pinch nozzle with a flame-spray gun in a way such that the adaptability or variability of the volume of the combustion chamber is retained. However, said variability is dependent upon the performance data of the spray gun used. If such dependence is undesirable and if it is desirable to process not only powder, but also wire as the spray additive, the nozzle holder is designed as a suitably adapted nozzle assembly while the basic principle is being retained.

The solution according to the invention offers the following advantages with respect to the spray coatings: It was found that with high-melting materials (oxides, cermets, high-melting metals etc.), the quality of the coating can be significantly enhanced, and the density in the applied coating is substantially increased as compared to conventional coatings applied by flame spraying. Furthermore, the adhesive strength is significantly enhanced due to the higher kinetic energy of the spray particles, and, moreover, the sprayed-on coating is not impaired by powder particles that baked on or adhered in the channel of the pinch nozzle and are sooner or later stripped off again. The otherwise unavoidable spraying losses are significantly reduced for targeted spray coatings due to the pinching of the jet.

Furthermore, spray additives can be used which, until now, could not be sprayed only with a flame-spray gun. Moreover, the need for using all combustion gases commonly used in this field, in particular the need for using acetylene, is satisfied due to the fact that the volume of the combustion chamber can be adjusted in optimal ways, and finally, the operation of such a device does not require a costly electronic control system, but only simple electric switching and regulating for assuring that the steps for the ignition are initiated in the correct sequence. For the operationally safe ignition during start-up and the usability of the device in general, it is important that the ignition is carried out with the following steps in order to reduce the combustible gascoxygen mixture for the start-up phase to a minimum: Flushing with pure oxygen, activation of the ignition system and only then admission or feeding of the combustion gas. If said sequence were not followed, ignition directly in front of the nozzle of the flame-spray gun would lead to an explosion and possibly extinction of the flame, or, with ignition on the orifice of the pinch nozzle, which is the case with the device according to the afore-mentioned German Pat. DAS No. 1 089 614, to backfiring into the nozzle and extinction of the flame. Of course, even with the device according to the present invention, said important sequence required for the start-up phase could be manipulated by hand on the flame-spray gun for the gas feed, including switch-on of the ignition system, however, this would be too complicated and too unsafe.

As concerns the ignition system equipped with an electrode, it was found that it is important for the continuous operational efficiency of the device that once ignition is accomplished, the electrode can be retracted from the combustion chamber in order not to interfere, on the one hand, with the flow into the combustion chamber, and not to hinder the adjustment of the volume of the combustion chamber to the given conditions. In practical applications, this means that the nozzle and the electrode are joined in the ignition position, and that subsequently, the optimal volume of the combustion chamber can be set as required without hindrance on part of the electrode.

In the combustion chamber, which has to be variable with respect to its size also with the flame-spray gun-and-pinch nozzle combination, the combustion of the mixed gases takes place in a largely controlled way; however, said combustion may nevertheless lead to temperatures that may even cause metal evaporation. For this reason, the wall of the combustion chamber is designed in a way such that it can be cooled.

Since the volume of the combustion chamber of the device of the present invention is variable due to the adjustment arrangement of the nozzle or nozzle assembly, the dwelling time of the powder particles in the combustion chamber can be influenced, i.e., the powder is suitably preheated or heated in a controlled manner to the desired temperature before it is highly accelerated for the feed into the pinch nozzle. In this connection, it is important that a flow-accelerating transition contour is provided between the combustion chamber and the mouth of the channel of the pinch nozzle. Advantageously, said contour has a convex shape with respect to the axis of the device, which, in the present case, is of special importance in that the powder particles exiting from the combustion chamber in a state in which they at least begin to melt, may otherwise deposit already within the zone of the mouth of the channel of the pinch nozzle. If, with a design unfavorable to the flow, said zone is not completely clogged due to the accumulation of such particles, such deposits pose the hazard of being torn loose, and no optimal coating results are achieved if such torn-off particles are transported into the coating.

By changing the size of the combustion chamber or by changing even the length of the pinch nozzle, if need be, both high-melting and low-melting spray additives may be sprayed, and, finally, it is possible to feed atomizing gases or additional gases, by means of which the mode of operation of the device can be controlled.

Therefore, advantageously, the pinch nozzle is designed to comprise a number of parts, which permits adapting the length of said nozzle to the spraying material to be processed. This is explained hereinafter in greater detail.

With the design of the device with a nozzle assembly, the powder—when powder is sprayed—is conveyed by an external powder feeding system permitting a uniform conveyance of the powder. If wire is processed as the spraying additive, the wire stock is fed by means of an external device also, said device being a wire feeding system of the known type.

It was found that it is advantageous in particular when the device is operated for longer periods (and this applies to both variations) to provide for a superficial flow in the interior channel of the pinch nozzle, which can be achieved in a simple way in terms of engineering. This is advantageous because by such a superficial current pattern, caking of the melted particles on the walls of the interior channel is prevented, which is important if the equipment is in operation for longer periods.

Depending on the length of the pinch nozzle, additional devices for producing such a superficial current may be provided within the first half of said nozzle on the inlet side, preferably within the zone of the inlet, where such a current may be produced, for example by feeding inert gas. Furthermore, it is possible also to form at least part of the wall of the channel of the pinch nozzle from a porous material such as, by way of example, a ceramic material, and to encase or envelope said shaped body with a hollow space into which pressurized gas is admitted. The gas so admitted under pressure, which may also be a combustible gas, will then form in the channel a mantle layer, and caking of molten particles on the wall is practically no longer possible.

The interior channel of the pinch nozzle does not have to be cylindrical, but may be designed in a way such that it is conically expanding towards the orifice of the nozzle.

Apart from the practical embodiments described in greater detail in the following and the advantageous additional features, the solution according to the invention provides a device that is extremely simple in terms of engineering in that one part of said device even may be designed as a conventional flame-spray gun which, due to the simple adaptability of the volume of the combustion chamber, is accessible to all combustion gases or combustion gas mixtures commonly used in this field, and which assures a safe ignition.

Consequently, an important feature of the device according to the invention is the design of the combustion chamber accommodating the feed nozzle for the combustion gases and the stream of carrier gas, said nozzle being adjustable in the longitudinal direction. Thus the size of the combustion chamber is variable and only the gases spent in the combustion chamber are accelerated into the channel of the pinch nozzle. This means that also the powder particles are first delivered to the combustion chamber, where they are adapted or melted to a lesser or higher degree, and then admitted in said state into the pinching channel. Furthermore, an important design feature is the arrangement of a retractable ignition electrode in the combustion chamber in order to assure that only a relatively small amount of combustion gas mixture is ignited in the combustion chamber when the device is started up.

The device according to the invention will be described hereinbelow in greater detail in presently preferred embodiments shown in the drawing, in which.

Figure 1:
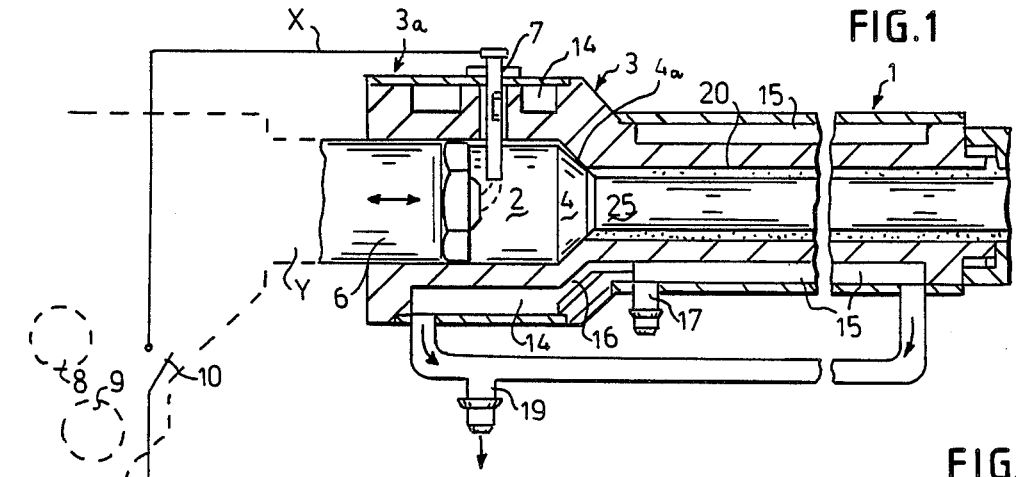
FIG. 1 is a schematic sectional view of a device comprised of a flame-spray gun/pinch nozzle combination.

According to FIG. 1, the device is comprised of the following important components: The flame-spray gun 6″ shown in broken lines, an adapter 3 defining the combustion chamber 2, the pinch nozzle 1 and the ignition device with the electrode 7. The flame-spray gun 6″ is known per se and thus no detailed description is needed. The receiving bore of the adapter 3, of course, has to be dimensioned in such a way that the head 6*a*, of the flame-spray gun 6″ can be inserted therein, said head also accommodating the burner nozzle 5. The flame-spray gun head may be fixed in various positions (see double-headed arrow) so as to permit adaption of the combustion chamber 2 to the given requirements. The ignition electrode 7 is arranged axially adjustably (see double-headed arrow) so that a suitable ignition gap can be adjusted with respect to the burner nozzle 5 and an ignition arc or spark can be briefly generated for the ignition.

Figure 5:
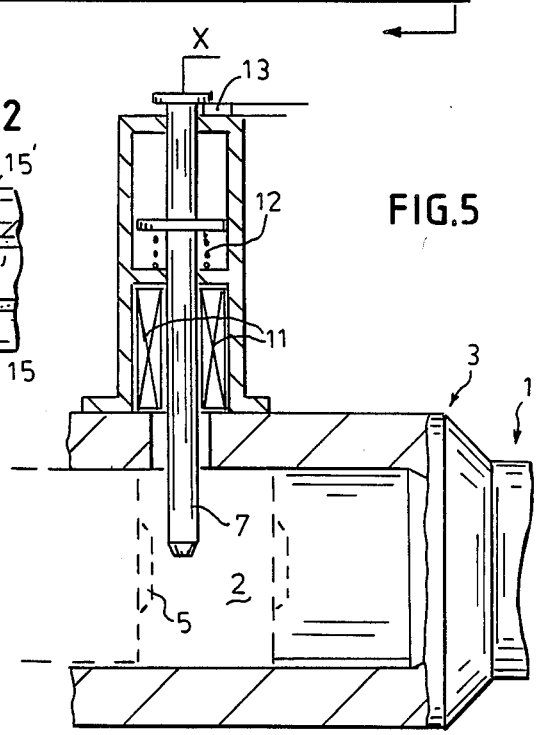
FIG. 5 is a schematic view of a preferred embodiment of the electrode in the adpater of FIG. 1.

As shown in FIG. 5, the ignition system is designed as follows: The electrode 7 forms the armature of a magnetic coil 11 which, on excitation, displaces the electrode 7 against the action of a return spring 12 into the illustrated ignition position next to the nozzle 5. When in said posistion, the ignition current is switched on by a limit switch 13 (see FIG. 6). Once ignition has been achieved, the current supplied to coil 11 is switched off to return the electrode 7 by means of the return spring 12. It is important for the ignition operation that the ignition takes place not only when the combustion chamber 2 is filled with a combustible gas mixture but as soon as it starts to flow into the combustion chamber.

FIG. 1 shows that the pinch nozzle 1 including the adapter 3 is designed in such a way that it can be cooled by water, cooling ducts 14 and 15 being connected by a connecting line 16. The connection 17 for feeding the coolant to the cooling ducts 14 and 15 is arranged where the pinch nozzle 1 is joined with the adapter 3, and a common coolant draining connection 19 is provided for the two ducts 14 and 15.

Figure 3:
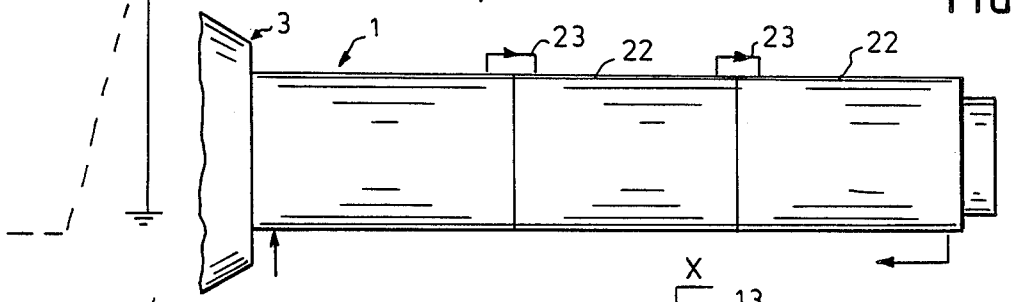
FIG. 3 shows a schematic side elevational view of a special embodiment of the pinch nozzle.

FIG. 3 shows that the pinch nozzle 1 may be comprised of individual parts 22, which can be connected with each other, for the purpose of permitting adaption of the length, and parts 22 are connected with each other by bridging ducts 23 for passing through the coolant, unless each individual component 22 is provided with separate feeding and discharging connections.

Figure 4:
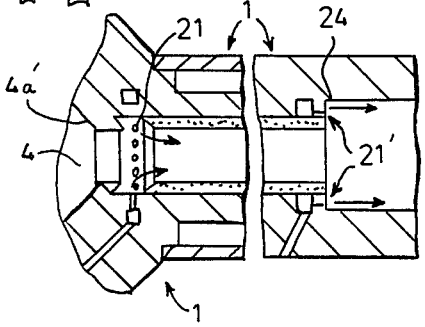
FIG. 4 shows a schematic sectional fragmentary view of the embodiment of FIG. 1, illustrating a special means for creating a circumferential flow pattern.

For the purpose of creating the afore-mentioned circumferential flow pattern within the pinch nozzle 1, an annular array of gas feeding openings 21 (shown schematically in FIG. 4) are provided adjacent the constricted mouth 4 of the adapter, which is defined by transition contour 4*a*. Furthermore, like gas feeding openings 21′ may be additionally provided in the shadow range of the flow within a shoulder 24 (right-hand side in FIG. 4). This modification may be used with the device according to FIGS. 1 and 2.

The head 6*a* of (flame-spray gun 6″) capable of being adjustably received in the bore of adapter 3 is advantageously provided with a marking or with an adjustable stop means on its periphery to assure that its burner nozzle 5 is set with the correct ignition distance with respect to electrode 7.

Usefully, the ignition system or the electrode 7 is arranged in zone 3*a* defining combustion chamber 2 of the adapter 3 on the clip-on side, so that the opening in the adapter wall for the electrode 7 is covered even when the volume of the combustion chamber 2 is set for the highest value. This is advantageous in view of the high temperatures in the combustion chamber 2.

Figure 2:
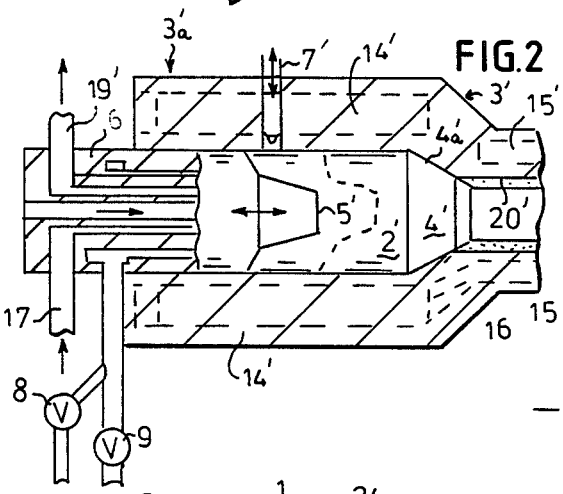
FIG. 2 shows a schematic sectional fragmentary view of a device comprised of a nozzle assembly/pinch nozzle combination.

The difference between the embodiment shown in FIG. 2 and the one according to FIG. 1 is practically only that a suitably adapted nozzle assembly or nozzle holder 6 is used instead of the flame-spray gun 6″. With nozzle holder 6, it is possible to use not only powder spraying materials but also spraying materials in the form of a wire. The powder reservoir or supply tank for the flame-spray gun (FIG. 1) and the elements for feeding wire-shaped spraying material to the nozzle holder according to FIG. 2 are not shown, because such elements are generally known. Of course, the nozzle holder 6 according to FIG. 2 may be equipped also with a connection for a powder reservoir or powder feed line. Like parts of the embodiment according to FIG. 2 are identified by like reference numerals provided with the (′).

It is important for the safe start-up and operation of the device of FIGS. 1 and 2 that controller 8 controlling the feeding of the combustion gas and controller 9 controlling the feeding of oxygen or compressed air to the burner nozzle are so designed and coordinated with switch-on element 10 of the ignition control circuit (see FIG. 6) that the flushing of the pinch nozzle with oxygen or compressed air, the switch-on of the ignition system and the feeding of the combustion gas are effected sequentially. Suitable regulating, timing and control circuit elements are readily available in commerce for this purpose.

Figure 8:
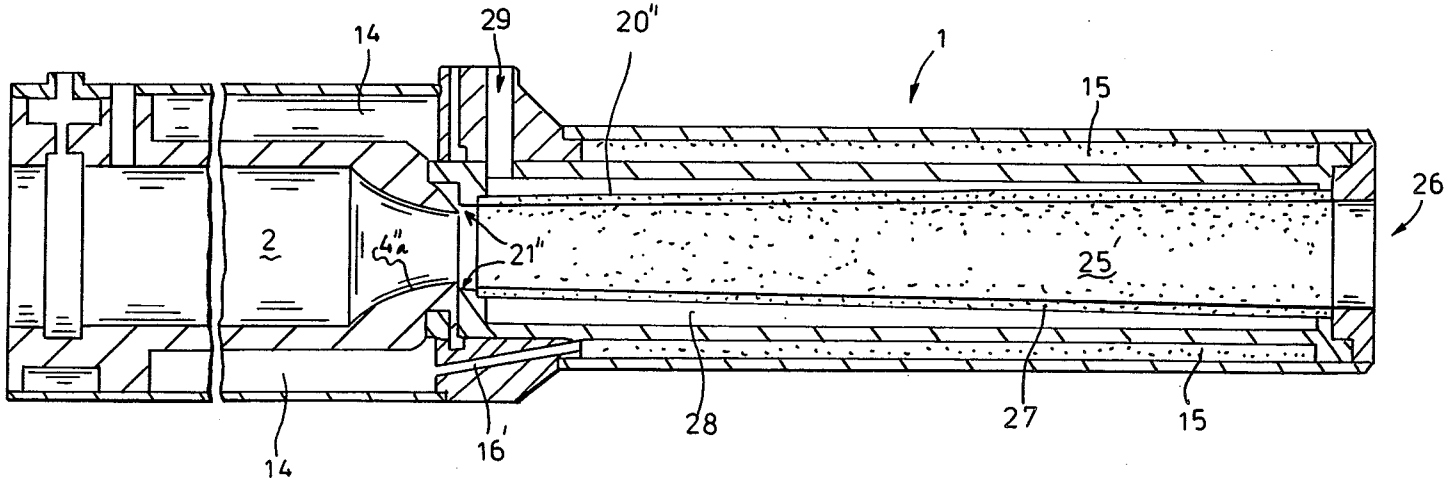
FIG. 8 is a schematic sectional view of another embodiment.

The flame-spray gun or the nozzle assembly and the electrode and connecting lines are not shown in FIG. 8, which clearly shows the convex shape of the transition contour 4*a* extending from the combustion chamber 2 to the chamber 25′ of the pinch nozzle, which is slightly outwardly conically tapered towards the orifice 26. Pinch nozzle channel 25 of the embodiments according to FIGS. 1 and 2 may be similarly tapered. Furthermore, as in the embodiments of FIGS. 1 and 2, the pinch nozzle channel is defined—by a shaped body 20″ made of porous material permeable to gas. In the embodiment of FIG. 8, shaped porous body 20″ is enclosed by a hollow space 28 capable of being fed with pressurized gas, said gas being admitted by way of a pressurized gas feeding connection 29. Advantageously, hollow space 28 has a volume gradually decreasing from the feeding connection 29 to orifice 26 to assure that the pressurized gas transpiring through the porous material of the shaped body 20″ is distributed as uniformly as possible over the total length of said porous body. By way of example, the shaped body 20″ is made of sintered $Al_2O_3$ or $ZrO_3$ or mixtures thereof. Since shaped body 20″ is permeable to gas across its total surface, a gas cushion is formed in the manner of the afore-mentioned circumferential flow pattern which, in a manner of speaking, constantly renews itself, whereby it is entirely possible to arrange the additional openings 21″ directly next to the transition contour 4′. The pressurized gas supplied by way of the connection 29 also may be a combustible gas effecting an additional acceleration of the total flow within the channel 25′ of the pinch nozzle.

Figure 6:
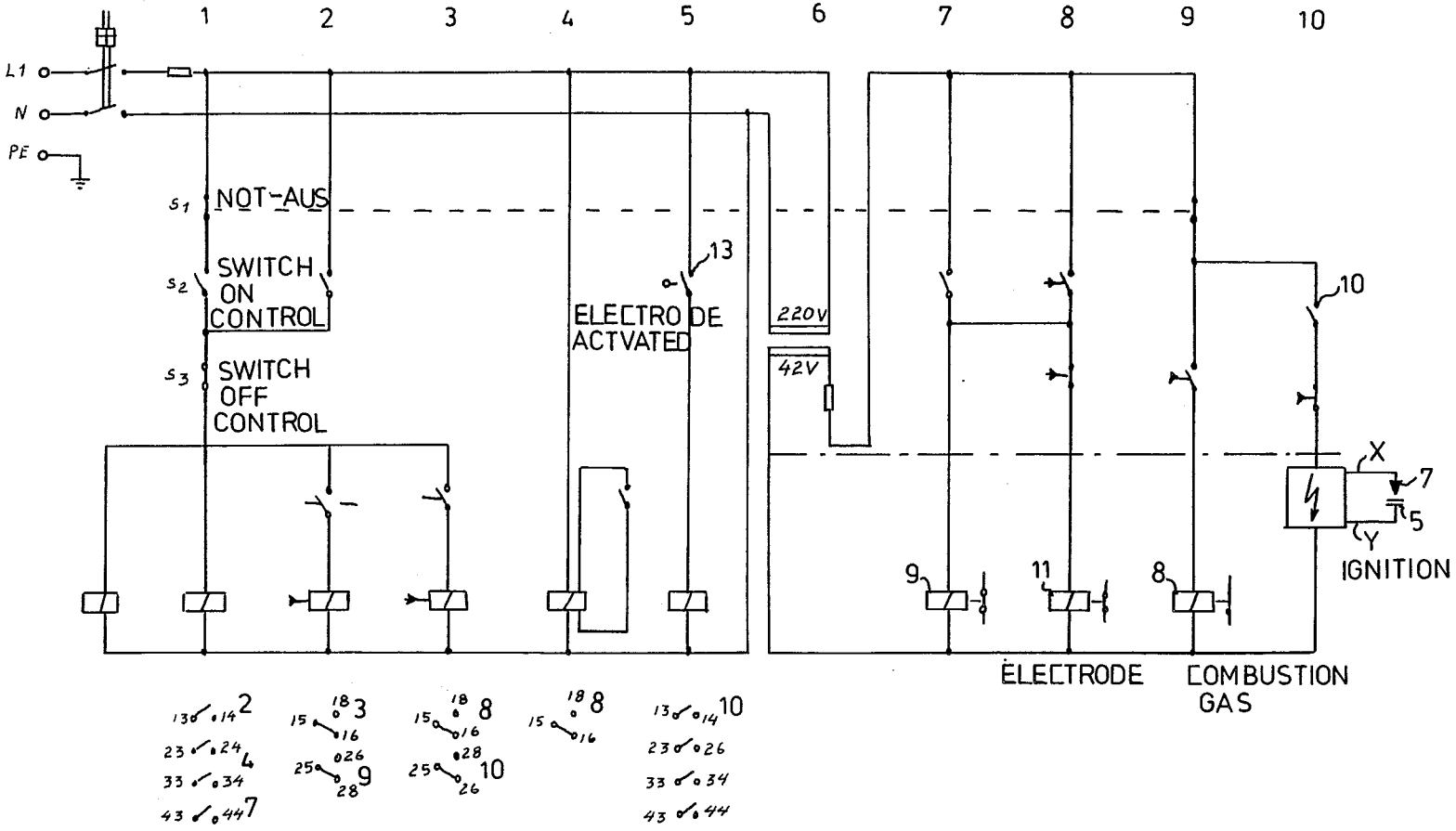
FIG. 6 shows a circuit diagram for the device.

In the circuit diagram shown in FIG. 6, the large reference numerals 5, 7, 8, 9, 10, 11, 13 and X, Y, respectively, correspond to the reference symbols used in FIGS. 1 to 5 and the operation of the control is obvious from the above description.

Figure 7:
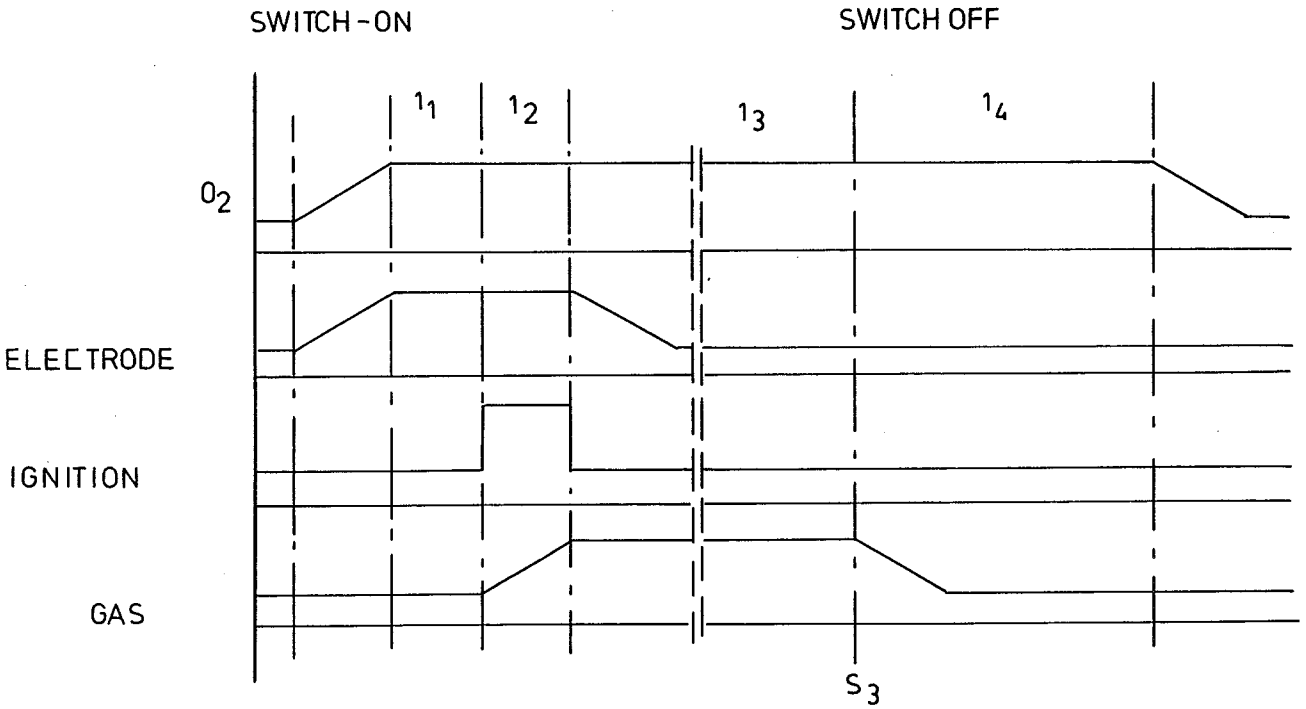
FIG. 7 shows a diagram illustrating the operation of the device.

The operating sequence shown in FIG. 7 is assured by the time delay relays $K_6$, $K_2$, $K_3$, $K_4$ and associated switching elements illustrated in FIG. 6; $t_3$ represents the actual operating phase. For example, the ignition curve shows that the ignition current flows only during time interval $t_2$, in which the combustion gas starts to flow in. The electrode curve illustrates that the electrode is retracted immediately after interval $t_2$. During the interval $t_4$, i.e., after the control has been switched off at $S_3$, the feed of combustion gas is shut off immediately, whereas the feed of oxygen may continue for a brief period for flushing purposes.

We claim:

1. A device for the thermal spray application of a fusible material, which comprises
   (a) a nozzle defining an elongated, axially extending spray channel,
   (b) an inlet leading to said spray channel and coaxial therewith, the inlet having a flow-accelerating contour,
   (c) a combustion chamber leading to the inlet and coaxial therewith, the combustion chamber having a diameter larger than that of the spray channel,
   (d) a nozzle head displaceably mounted in the combustion chamber and axially adjustable with respect to the inlet, the nozzle head carrying
      (1) a burner nozzle,
      (2) respective conduit means for feeding a combustion gas and a spray channel flushing gas into the combustion chamber, and
      (3) means for feeding the fusible material into the combustion chamber,
   (e) an ignition electrode projecting into the combustion chamber and being arranged for adjustment with respect to the burner nozzle in a direction transverse to the axis, and
   (f) a control circuit controlling the feeding of the combustion gas and the feeding of the flushing gas through the respective conduit means, the control circuit including
      (1) a switching element for supplying electric current to the ignition electrode whereby a spark is formed between the ignition electrode and the burner nozzle for igniting the combustion gas in the combustion chamber, the control circuit being arranged to actuate the switching element for supplying the electric current to the ignition electrode after feeding the flushing gas and prior to feeding the combustion gas.

2. The device of claim 1, wherein the flow-accelerating inlet contour is convex with respect to the axis.

3. The device of claim 1, further comprising an adapter having a wall defining an axial bore constituting the combustion chamber, the nozzle head is adjustably plugged into the axial bore, and the ignition electrode is adjustably mounted in the adapter wall.

4. The device of claim 3, wherein the ignition electrode constitutes an armature of an electromagnetic coil, and further comprising a return spring biasing the electrode away from the burner nozzle, and a switch for supplying electric current to the coil whereby the ignition electrode is displaced towards the burner nozzle against the bias of the return spring.

5. The device of claim 3, wherein the ignition nozzle is mounted in the adapter wall on a side of the adapter where the nozzle head is plugged into the axial bore.

6. The device of claim 1, further comprising cooling ducts surrounding the nozzle and the combustion chamber, the cooling ducts being interconnected.

7. The device of claim 6, further comprising a common inlet for coolant for the cooling ducts, the common inlet being arranged close to the inlet to the spray channel, and a common outlet for draining the coolant from the cooling ducts.

8. The device of claim 1, further comprising an exchangeable nozzle tube extending axially along the length of the nozzle and defining the spray channel.

9. The device of claim 8, wherein the nozzle tube is of a porous, gas-permeable material.

10. The device of claim 9, wherein a hollow annular space surrounds the porous, gas-permeable nozzle tube, and further comprising conduit means for charging the hollow annular space with a gas under pressure.

11. The device of claim 10, wherein the hollow annular space gradually decreases in volume from the inlet.

12. The device of claim 1, further comprising an annular array of gas feeding openings arranged between the inlet and the spray channel for creating a circumferential gas flow pattern along the interior wall of the spray channel.

13. The device of claim 1, wherein the nozzle is constituted by a plurality of interconnected individual nozzle parts.

14. The device of claim 1, wherein the control circuit comprises respective controllers for feeding the combustion gas and the flushing gas through the respective conduit means, the control circuit sequentially operating the controller for feeding the flushing gas, the switching element for supplying electric current to the ignition electrode and the controller for feeding the combustion gas.

* * * * *